US010405095B2

(12) United States Patent
Eichfeld et al.

(10) Patent No.: US 10,405,095 B2
(45) Date of Patent: Sep. 3, 2019

(54) AUDIO SIGNAL PROCESSING FOR HEARING IMPAIRMENT COMPENSATION WITH A HEARING AID DEVICE AND A SPEAKER

(71) Applicant: BOSE CORPORATION, Framingham, MA (US)

(72) Inventors: Jahn D. Eichfeld, Worcester, MA (US); Davis Pan, Arlington, MA (US)

(73) Assignee: BOSE CORPORATION, Framingham, MA (US)

( * ) Notice: Subject to any disclaimer, the term of this patent is extended or adjusted under 35 U.S.C. 154(b) by 25 days.

(21) Appl. No.: 15/087,951

(22) Filed: Mar. 31, 2016

(65) Prior Publication Data

US 2017/0289683 A1 Oct. 5, 2017

(51) Int. Cl.

| | |
|---|---|
| ***H04R 25/00*** | (2006.01) |
| ***H04R 3/12*** | (2006.01) |
| ***H04R 5/02*** | (2006.01) |
| ***H04R 29/00*** | (2006.01) |

(52) U.S. Cl.

CPC ..... *H04R 3/12* (2013.01); *H04R 5/023* (2013.01); *H04R 29/002* (2013.01); *H04R 25/554* (2013.01); *H04R 2205/041* (2013.01); *H04R 2499/13* (2013.01)

(58) Field of Classification Search

CPC ..... H04R 25/55; H04R 25/552; H04R 25/554
USPC ..... 381/23.1, 312, 315, 300, 301, 309, 311
See application file for complete search history.

(56) References Cited

U.S. PATENT DOCUMENTS

| | | | | |
|---|---|---|---|---|
| 6,744,898 | B1 * | 6/2004 | Hirano | H04R 5/023 381/301 |
| 8,565,908 | B2 | 10/2013 | Sabin et al. | |
| 2003/0045283 | A1 * | 3/2003 | Hagedoorn | H04M 1/6066 455/426.1 |
| 2006/0008091 | A1 * | 1/2006 | Kim | H04S 7/00 381/17 |
| 2007/0127749 | A1 * | 6/2007 | Menzl | H04R 25/30 381/312 |
| 2008/0080733 | A1 * | 4/2008 | Mei | H04R 1/1066 381/379 |
| 2014/0294198 | A1 * | 10/2014 | Hall | H04R 3/02 381/93 |
| 2015/0004954 | A1 | 1/2015 | Sabin | |
| 2015/0012282 | A1 | 1/2015 | Sabin et al. | |
| 2015/0350795 | A1 | 12/2015 | Sabin | |
| 2015/0365771 | A1 * | 12/2015 | Tehrani | H04R 25/554 381/315 |
| 2016/0330546 | A1 * | 11/2016 | Barrentine | H04R 3/04 |

OTHER PUBLICATIONS

U.S. Application entitled "Audio Systems for Providing Isolated Listening Zones", 43 pp.

* cited by examiner

*Primary Examiner* — Katherine A Faley
(74) *Attorney, Agent, or Firm* — Patterson + Sheridan, LLP

(57) ABSTRACT

A system and processes for a proximate-speaker audio compensation system include a first speaker and a second speaker that are proximate to a user. A control unit couples to at least one of the first speaker or the second speaker. The control unit adjusts audio signal based on a hearing-aid type adjustment. The control unit sends adjusted audio signal to the at least one of the first speaker or the second speaker.

18 Claims, 5 Drawing Sheets

AUDIO SIGNAL PROCESSING FOR HEARING IMPAIRMENT COMPENSATION WITH A HEARING AID DEVICE AND A SPEAKER

I. FIELD OF THE DISCLOSURE

The present disclosure relates in general to an audio compensation system, and more particularly, to binaural hearing compensation using proximate speakers.

II. BACKGROUND

A number of people who suffer hearing loss will have different audio compensation requirements for their left and right ears. To achieve differing audio compensation, individuals can use hearing aids, earphones, or headphones that offer independent left and right signal processing or both left and right signal processing.

III. SUMMARY

All examples and features mentioned below can be combined in any technically possible way.

In one aspect, a proximate-speaker audio compensation system includes a first set of one or more speakers and a second set of one or more speakers that are proximate to a user. The proximate-speaker audio compensation system also includes a control unit. The control unit couples to at least one of the first set or second set of speakers and adjusts an audio signal based on a hearing-aid type adjustment. The hearing-aid type adjustment may be in accordance with U.S. Patent Publication No. 8,565,908, U.S. Patent Publication No. 2015/0350795, U.S. Patent Publication No. 2015/50004954, and U.S. Patent Publication No. 2015/0012282, each of which is incorporated in its entirety for purposes of this specification. According to a particular implementation, the control unit sends the adjusted audio signal to the at least one of the first set or second set of speakers.

In another aspect, the control unit is associated with a vehicle on-board system. The vehicle on-board system provides individualized adjustment of the audio signal for each occupant of a vehicle. According to an implementation, adjustment of the audio signal corresponds to at least one of asymmetric or symmetric correction of audio signal that is to be received by at least one of the user's ears. According to another implementation, adjustment of the audio signal corresponds to at least one of asymmetric or symmetric correction to audio signals that are to be received by both of the user's ears. The audio signals may correspond to stereo audio (e.g., music) or monoaural audio (e.g., telephony, navigation prompts, etc.).

In another aspect, the control unit couples to a hearing aid device proximate (e.g., close or within a detection range) to the control unit. Proximity of the hearing aid device may be detected by Bluetooth connection between the hearing aid device and the control unit, a near-field magnetic induction, or a near-field communication. The control unit decouples the first set and second set of speakers from receiving the audio signal upon a determination that the hearing aid device is coupled to the control unit. According to a particular implementation, the control unit sends the audio signal to the hearing aid device.

In another aspect, the control unit couples to the hearing aid device and sends speech signal of the audio signal to the hearing aid device and entertainment signal of the audio signal to the first set and second set of speakers.

In another aspect, a proximate-speaker audio compensation system includes a control unit. The control unit couples to a hearing aid device. The hearing aid device is proximate to or within a predetermined detection range of the control unit. According to a particular implementation, the control unit decouples one or more speakers proximate to the hearing aid device from receiving audio signal upon a determination that the hearing aid device is coupled to the control unit. The control unit may send the audio signal to the hearing aid device. According to another particular implementation, the control unit adjusts the audio signal. Adjustment of the audio signal is based on at least one of: a stored audio adjustment profile associated with a user, a manual audio adjustment of the user, and a learned audio adjustment profile of the user. The stored audio adjustment profile may correspond to loudness and fine tuning settings as described in U.S. Pat. No. 9,131,321, U.S. Patent Publication No. 2015/0271607, U.S. Patent Publication No. 2015/0271608, and U.S. Patent Publication No. 2015/0125012, each of which is incorporated in its entirety for purposes of this specification. The manual audio adjustment may correspond to bass, treble equalizer (EQ) modification, or both. The learned audio adjustment profile may correspond to a dynamically determined audio adjustment by the proximate speaker audio compensation system based on previous audio adjustments performed by the user.

In another aspect, a method includes coupling, by a control unit, to a hearing aid device proximate to the control unit. According to a particular implementation, the method includes decoupling one or more speakers proximate to the hearing aid device from receiving audio signal upon a determination that the hearing aid device is coupled to the control unit. The method may include sending the audio signal to the hearing aid device. According to another particular implementation, the method may include muting the hearing aid device, such that entertainment audio is heard only from a plurality of speakers. The hearing aid device may be unmuted when there is speech (e.g., telephony), where there is a navigation prompt, or when speech is detected (i.e., from metadata like FM RDS info suggesting talk radio or through an algorithm detecting speech.).

IV. BRIEF DESCRIPTION OF THE DRAWINGS

V. DETAILED DESCRIPTION

Figure 1:
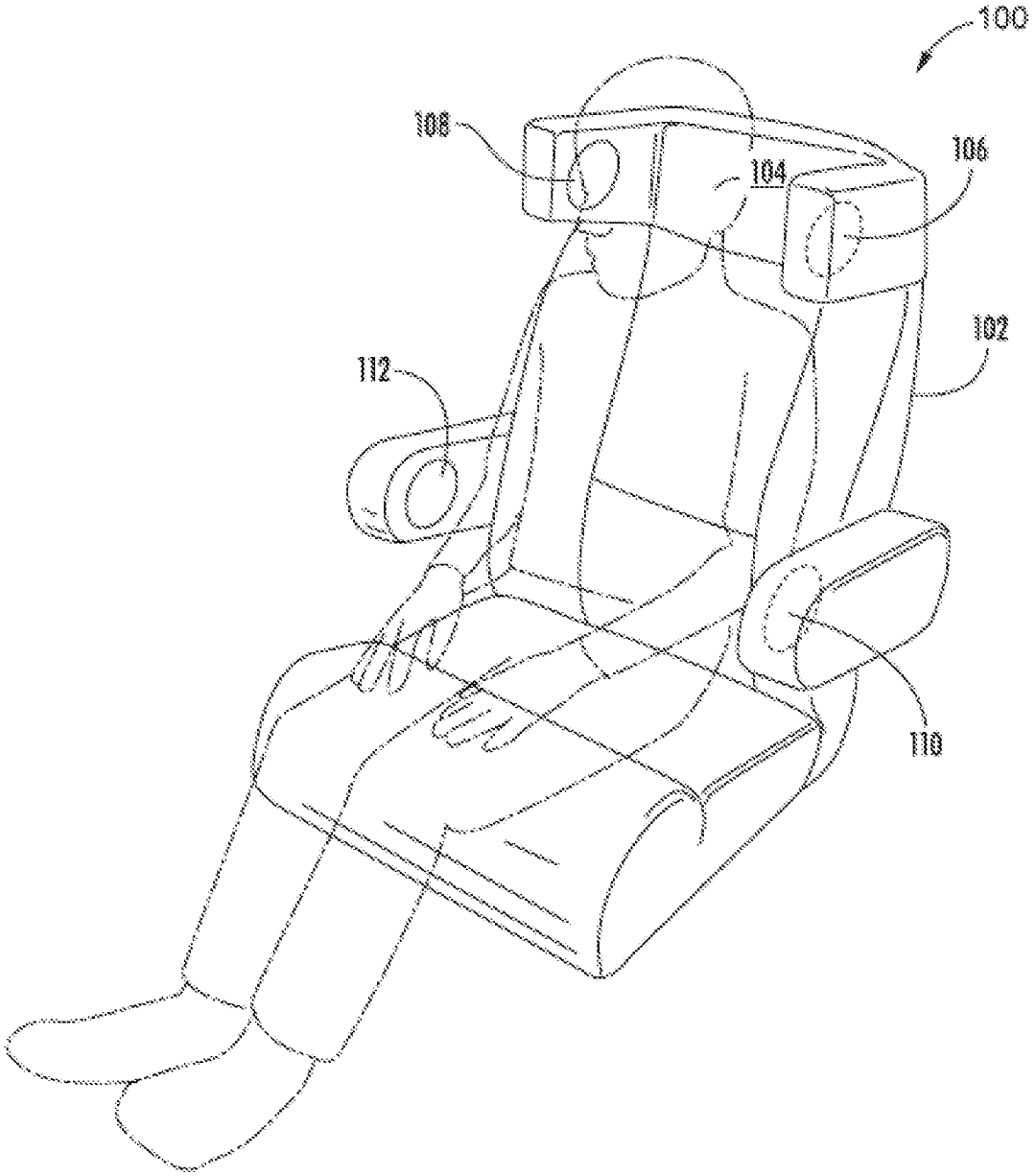
FIG. 1 is an illustrative implementation of a proximate-speaker audio compensation system.

A proximate-speaker audio compensation system enables people with asymmetric hearing loss to receive appropriate left hearing compensation, right hearing compensation, or both, without having to wear hearing aids, earphones, or headphones. Through crosstalk cancellation, the system may cancel the left audio signal at the right ear and the right audio signal at the left ear. The cancellation may enable the left and right audio signals to be processed for left and right ears, respectively, or both. Crosstalk cancellation is described in U.S. Pat. No. 9,215,545, which is incorporated in its entirety for purposes of this specification.

According to a particular implementation, the proximate-speaker audio compensation system is associated with left-right headrest speakers in at least one of: automotive audio systems, theater audio systems, home audio systems, airline audio systems, airport audio systems, or any combination thereof. According to another particular implementation, the proximate-speaker audio compensation system is associated with at least one of: vehicle speakers, smartphone speakers, in-seat speakers, armrest speakers, or speakers associated with a particular seat.

In one aspect, the proximate-speaker audio compensation system comprises an in-car audio compensation system for hearing loss. The in-car audio compensation system includes an in-car audio system (e.g., audio source, signal processor, amplifier, speakers), near-field audio system (e.g., headrest speakers with signal processing pursuant to hearing aid compensation), and compensation algorithms for hearing loss. Audio signals from a source are processed through the signal processor, where equalization (EQ) and other tuning-related processing occur. The source includes at least one of audio from a source device, telephony, or voice speech coming from an occupant of a car. The source device may include at least one of an in-car radio or a device that plays at least one of music, video, movies, or talk show programming.

One or more outputs of the signal processor are passed to amplifiers and loudspeakers in a periphery of the car. Near-field signal processing is also performed in the signal processor with the one or more outputs fed to in-seat speakers. Additional processing may also be provided by adding an additional processing stage in the signal processor. The additional processing is applied to the near-field signal, between the spatial enhancement output and cross-talk canceller input. The additional processing includes a dynamic range compression of the audio signal to increase audibility due to a hearing impairment.

Characteristics of the dynamic range compression are tuned using a hearing-control adjustment or multiple hearing-control adjustments included in at least one of a smartphone app, an audio source device (e.g., a user interface on a head unit) or other user interface. Because the signal processing occurs on a cross-talk cancelled path, each ear may be tuned for at least one of the user's asymmetric hearing loss or acoustic asymmetries. Implementation of cross-talk cancellation enables the left-ear to be equalized independent of a cross-contribution from the right-ear signal. In an example, such tuning may occur in an automobile.

When the dynamic range compression is applied to near-field speakers, (as opposed to speakers in the periphery of the vehicle), each occupant may have a particular tuned dynamic range compression. The particular tuned dynamic range compression is associated with zone isolation. The zone isolation comes from a relative proximity between one seat's speakers and its occupant to a different seat's occupant. Improvement to zone isolation with speaker arrays are described in U.S. Pat. Nos. 8,325,936, 8,4383,413, and U.S. Patent Publication No. 2008/0273722, each of which is incorporated in its entirety for purposes of this specification.

The particular tuned dynamic range compression may be based on at least one of: a hearing profile associated with a particular occupant, a manually user-adjusted hearing configuration for the particular occupant, or a learned audio adjustment profile for the particular occupant. The particular occupant may correspond to a user of the in-car audio compensation system.

In addition to a user that is hearing impaired, the in-car audio compensation system is used by a user with normal hearing. For example, processes account for masking effects of road noise that would otherwise degrade speech intelligibility, such as a voice in a talk radio programming. Thus, the in-car audio compensation system enables left audio signal processing, right audio signal processing, or both, to compensate for asymmetric signal-to-noise ratio impairment on each ear of the user. The processing is achieved without hearing aids or in-ear or on-ear headphones to separate the left and right audio signals. When audio processing is applied to near-field (e.g., headrest) speakers, particular audio signal compensation is individualized for each seat occupant in the car.

Turning to FIG. 1, an illustrative implementation of a proximate-speaker audio compensation system is shown. A proximate-speaker audio compensation system 100 includes a first set of one or more speakers and a second set of one or more speakers that are proximate to a user. According to a particular implementation, the first set and second set of speakers may be left 106 and right 108 speakers that are integrated with a headrest 104. In another example, the left and right speakers may be adjacent to, but not integrated with, the headrest. According to another or the same implementation, the first set and second set of speakers may be left 110 and right 112 speakers associated with armrests of a chair 102.

One skilled in the art will appreciate that the placement of the first set and second set of speakers in FIG. 1 is merely illustrative, and speakers in other examples may be placed anywhere in the chair 102 or structure proximate to a user seated in the chair 102. More particularly, the first and second speakers may be associated with a particular seat, but do not comprise part of the seat. For example, the first set and second set of speakers may be mounted, together or separately, on one or more supports, such as stands, walls, or any means to hold the first set and second set of speakers. The first set and second set of speakers may be positioned in a manner that direct output audio signals of the first set and second set of speakers to a user sitting on the chair 102. As such, the first set and second set of speakers may be near-field speakers. In another aspect, a proximate-speaker audio compensation system is associated with a smartphone, a wrist watch, an electronic device attached to at least one of a wrist or a shoulder, a computer, a vehicle on-board system, a cell phone, a monitor, or other nearby support.

Figure 2:
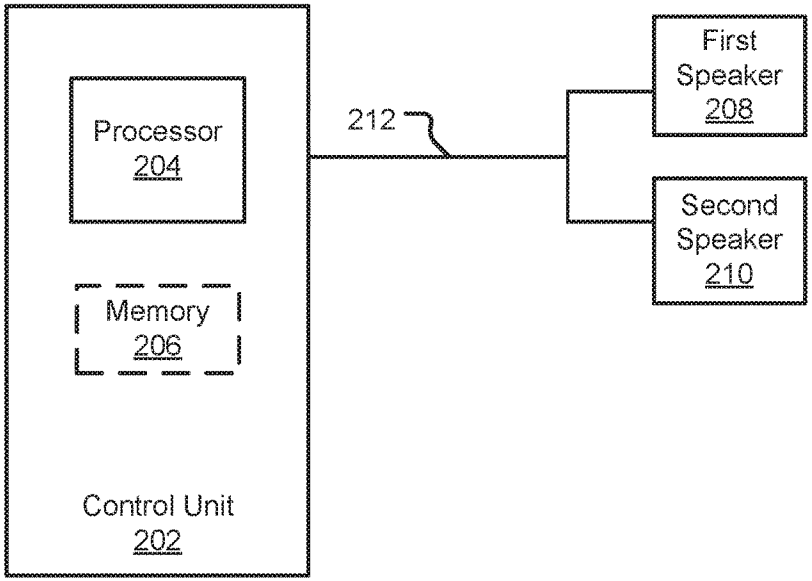
FIG. 2 is a block diagram of an illustrative implementation of a proximate-speaker audio compensation system.

FIG. 2 depicts a block diagram of an illustrative implementation of a proximate-speaker audio compensation system. A proximate-speaker audio compensation system 200 includes a first speaker 208 and a second speaker 210. The proximate-speaker audio compensation system 200 may correspond to the proximate-speaker audio compensation system 100 of FIG. 1. For instance, the first speaker 208 may correspond to the left speaker 106 of FIG. 1 or the left speaker 110 of FIG. 1. The second speaker 210 may correspond to the right speaker 108 of FIG. 1 or the right speaker 112 of FIG. 1. According to another implementation, the proximate-speaker audio compensation system 200 is associated with a smartphone, a wrist watch, an electronic device that is wrapped around on at least one of a user's wrist or shoulder, a computer, a vehicle on-board system, a cell phone, a monitor, or other proximate support.

The proximate-speaker audio compensation system 200 includes a control unit 202. The control unit 202 includes a processor 204. The control unit 202 may include a memory 206. The control unit 202 may additionally access an external memory (not shown). The control unit 202 may include any portable or vehicle-integrated computing device, such as iPad, laptop, personal digital assistant (PDA), etc. The memory 206 or the external memory stores hearing adjustment profiles for one or more users. The hearing adjustment profile is based on manually user-adjusted hearing configurations or one or more learned audio adjustment profiles particular to the users. The learned audio adjustment profiles include at least one of stored user-adjusted hearing configurations or machine learned hearing configurations.

Audio signals that each ear receives are configured by a user based on the user's acoustical preferences. The acoustical preferences are associated with at least one of: tuning equalization levels for particular frequencies that the user finds pleasing to hear, pitch of the audio signals, volume of the audio signals, signal processing of audio signals to remove unwanted noise, a level of dynamic range compression or some other nonlinear frequency-dependent level processing. The tuning equalization levels are further described patent references incorporated herein. Cross-talk cancellations may be applied to the audio signals by one or more processors. The user configures its acoustical preferences via a hearing-control adjustment, multiple-control adjustment, or an equalizer.

Figure 4:
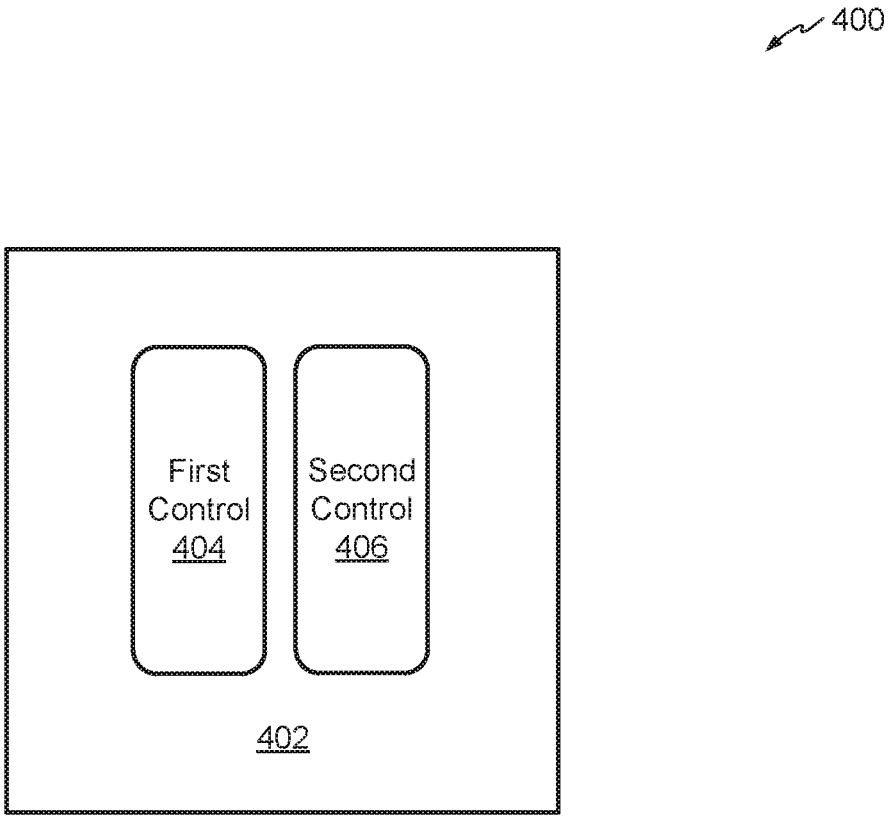
FIG. 4 is a block diagram of an illustrative representation of a hearing-control adjustment associated with a proximate-speaker audio compensation system.

In an example, the hearing-control adjustment includes two knob adjustments. FIG. 4 is a block diagram of an illustrative representation of a hearing-control adjustment associated with a proximate-speaker audio compensation system. The hearing-control adjustment may correspond to a two-control adjustment 400. The two-control adjustment 400 includes two knob adjustments 402. The two knob adjustments 402 include a first control 404 and a second control 406. According to a particular implementation, the first control 404 adjusts acoustical preferences particular to a left ear of a user. The second control 406 adjusts acoustical preferences particular to a right ear of the user. According to another particular implementation, the hearing-control adjustment includes multiple knob adjustments (not shown). Acoustical preferences are adjusted based on at least one of attenuation or amplification of audio signals.

Referring back to FIG. 2, the control unit 202 couples to at least one of the first speaker 208 or the second speaker 210. According to a particular implementation, coupling of the first speaker 208 or the second speaker 210 may be via one or more line connections 212. The coupling of the first speaker 208 or the second speaker 210 may alternatively be achieved via wireless connections (not shown).

The control unit 202 adjusts the audio signal based on a hearing-aid type adjustment. Adjustment of the audio signal is based on at least one of: a hearing profile associated with a user, a manually user-adjusted hearing configuration, or a learned audio adjustment profile for the user. The adjustment of the audio signal is associated with a hearing-control adjustment, multiple hearing-control adjustments, an equalizer, or a dynamic range compression. In one example, the adjustment of the audio signal corresponds to an asymmetric correction of the audio signal that is to be received by at least one of the user's ears. In another example, the adjustment of the audio signal corresponds to asymmetric correction to audio signals that are to be received by both of the user's ears.

Performing the asymmetric correction of the audio signal is based on processing audio signals to compensate for hearing loss associated with a left, right, or both ears. Compensation algorithms are run to: remove unwanted noise in the audio signal, adjust pitch on one or more frequencies associated with the audio signal, adjust amplitude associated with the audio signal to increase sound volume, modification of dynamic range compression parameters, and to provide signal modulation to enhance clarity of the audio signal. The asymmetric correction of the audio signal may be performed in the processor 204.

In another aspect, the control unit 202 receives a second audio signal. The second audio signal is associated with voice speech of a second user. The control unit 202 sends the second audio signal to the at least one of the first speaker 208 or the second speaker 210. The second audio signal is received by the user. The control unit 202 adjusts the second audio signal based on the hearing-aid type adjustment particular to the user. The control unit sends the adjusted second audio signal to at least one of the first speaker 208 and the second speaker 210. The control unit 202 may be implemented in at least one of: a smartphone, an armrest interface, a headrest interface, a wrist watch, a computer, a vehicle on-board system interface, a cell phone, and a monitor. According to a particular implementation, the control unit 202 that is associated with a vehicle on-board system provides individualized adjustments of audio signals for each occupant of the vehicle.

Figure 3:
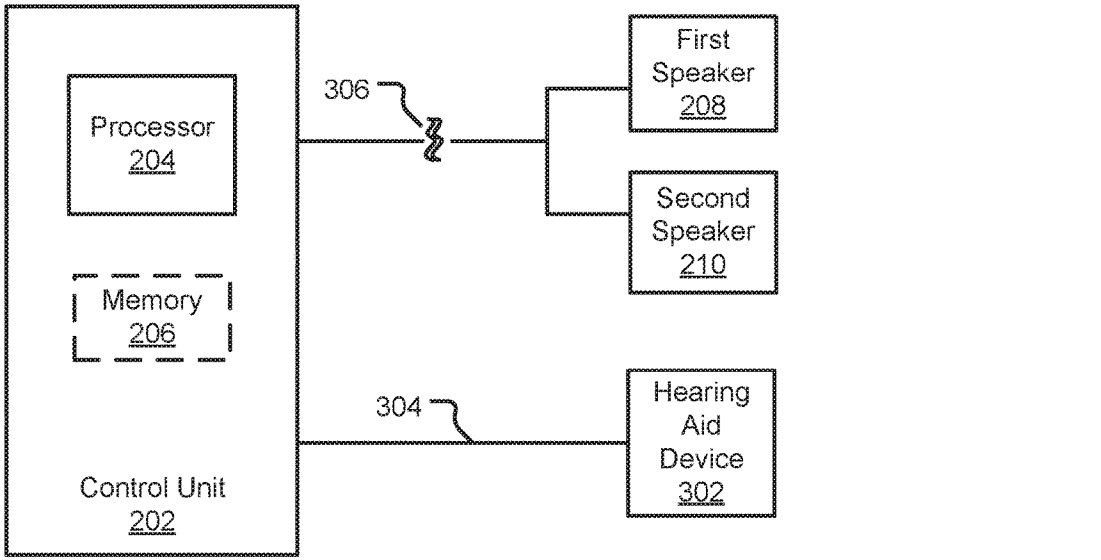
FIG. 3 is a block diagram of another illustrative implementation of a proximate-speaker audio compensation system.

FIG. 3 depicts a block diagram of another illustrative implementation of a proximate-speaker audio compensation system. The proximate-speaker audio compensation system 300 may be the proximate-speaker audio compensation system 200 of FIG. 2. In one aspect, the control unit 202 couples 304 to a hearing aid device 302. The hearing aid device 302 is coupled 304 via wireless (e.g., Bluetooth communication), near-field magnetic induction (NFMI), or near-field communication (NFC). The hearing aid device 302 is proximate to or otherwise within a detection range of the control unit 202. The control unit 202 decouples 306 the first speaker 208 and the second speaker 210 from receiving the audio signal upon a determination that the hearing aid device 302 is coupled 304 to the control unit. The control unit 202 sends the audio signal to the hearing aid device 302. In an example, the control unit 202 adjusts the audio signal prior to sending the audio signal to the hearing aid device 302 based on at least one of: a hearing profile associated with a user, a manually user-adjusted hearing configuration, and a learned audio adjustment profile of the user. According to another particular implementation, the proximate-speaker audio compensation system 300 includes the hearing aid device 302.

Figure 5:
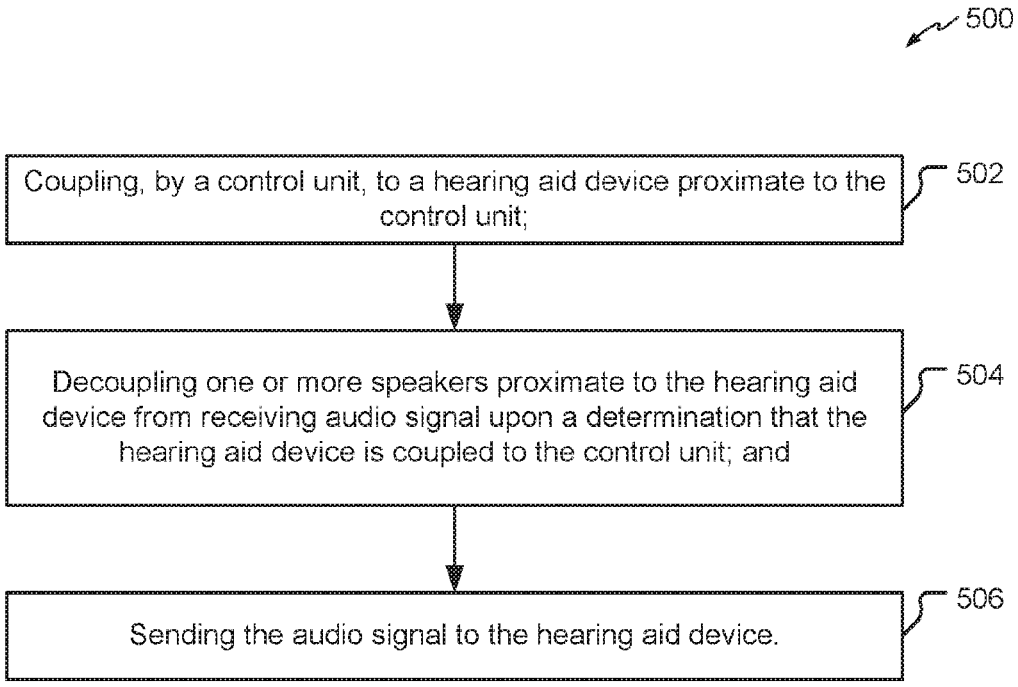
FIG. 5 is a flowchart of an illustrative implementation of a method for proximate-speaker audio compensation.

FIG. 5 depicts a flowchart diagram representing an implementation of a method for proximate-speaker audio compensation. A method 500 may be implemented in the proximate-speaker audio compensation system 100 of FIG. 1, the proximate-speaker audio compensation system 200 of FIG. 2, or the proximate-speaker audio compensation system 300 of FIG. 3. The method 500 may be implemented in the control unit 202 of FIG. 2 or the control unit 202 of FIG. 3. The method 500 includes, at 502, coupling, by a control unit, to a hearing aid device proximate to the control unit. According to a particular implementation, the control unit may be the control unit 202 of FIG. 2 or the control unit 202 of FIG. 3. The hearing aid device may correspond to the hearing aid device 302 of FIG. 3. The method 500 also includes, at 504, decoupling one or more speakers proximate to the hearing aid device from receiving an audio signal. The decoupling may be in response to a determination that the hearing aid device is coupled to the control unit. According to another particular implementation, the speakers may correspond to the left 106 and right 108 speakers of FIG. 1, the left 110 and the right 112 speakers of FIG. 1, the first speaker 208 and the second speaker 210 of FIG. 2, or the first speaker 208 and the second speaker 210 of FIG. 3. The method 500 may also include, at 506, sending the audio signal to the hearing aid device.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media or storage device, for execution by, or to control the operation of, one or more data processing apparatus, e.g., a programmable processor, a DSP, a microcontroller, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed one or more processing devices at one site or distributed across multiple sites and interconnected by a network.

Actions associated with implementing all or part of the functions can be performed by one or more programmable processors or processing devices executing one or more computer programs to perform the functions of the processes described herein. All or part of the functions can be implemented as, special purpose logic circuitry, e.g., an FPGA and/or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

Those skilled in the art may make numerous uses and modifications of and departures from the specific apparatus and techniques disclosed herein without departing from the inventive concepts. For example, selected implementations of an audio signal processing via cross-talk cancellation for hearing impairment compensation in accordance with the present disclosure may include all, fewer, or different components than those described with reference to one or more of the preceding figures. The disclosed implementations should be construed as embracing each and every novel feature and novel combination of features present in or possessed by the apparatus and techniques disclosed herein and limited only by the scope of the appended claims, and equivalents thereof.

The invention claimed is:

1. An apparatus comprising:

a speaker proximate to a hearing aid device; and a control unit to:

couple to at least one of the speaker and the hearing aid device;

access a hearing impaired profile associated with the hearing aid device;

determine a first audio signal is to be output by the apparatus;

in response to the determination:

muting the hearing aid device;

adjusting the first audio signal based on the hearing impaired profile; and sending the adjusted first audio signal to the speaker, such that the first audio signal is output only from the speaker; and determine a second audio signal is to be output by the hearing aid device, wherein the second audio signal comprises speech; and in response to the determination that the second audio signal is to be output:

unmuting the hearing aid device;

adjusting the second audio signal based on the hearing impaired profile; and sending the adjusted second audio signal to the hearing aid device.

2. The apparatus of claim 1, wherein the control unit comprises at least one of: a smartphone, an armrest interface, a headrest interface, a wrist watch, a computer, a vehicle on-board system interface, a cell phone, a monitor, and any portable or vehicle-integrated computing device.

3. The apparatus of claim 1, wherein the hearing impaired profile includes at least one of: a manual adjustment and a learned audio adjustment.

4. The apparatus of claim 1, wherein adjustment of the first or second audio signal corresponds to an application of asymmetric correction for a left and right ear of a user associated with the hearing impaired profile.

5. The apparatus of claim 1, wherein adjustment of the first or second audio signal corresponds to an application of at least one of asymmetric correction for a left and right ear of a user associated with the hearing impaired profile, symmetric correction for the left and right ear of the user associated with the hearing impaired profile, or a combination thereof.

6. The apparatus of claim 1, wherein the speaker is a near-field speaker.

7. The apparatus of claim 1, further comprising another speaker, wherein the speaker and the other speaker comprise left-right headrest speakers that are included in at least one of: an automotive audio system, a theater audio system, a home audio system, an airline audio system, and an airport audio system.

8. The apparatus of claim 1, wherein adjustment of the first or second audio signal is associated with particular adjustment of a plurality of frequencies for each ear of a user.

9. The apparatus of claim 1, further comprising a memory configured to store the hearing impaired profile.

10. The apparatus of claim 9, wherein the hearing impaired profile is based on user input.

11. The apparatus of claim 9, wherein the memory is included in the control unit, and wherein the control unit is associated with a vehicle on-board system configured to provide individualized adjustment of the first or second audio signal for each occupant of a vehicle.

12. The apparatus of claim 1, wherein adjustment of the first audio signal corresponds to individualized attenuation or amplification of the first audio signal for each ear of a user.

13. The apparatus of claim 12, wherein the adjustment of the first audio signal further corresponds to application of cross-talk cancellation associated with the speaker.

14. The apparatus of claim 1, wherein the control unit is further configured to mute the hearing aid device based on at least one of a manually adjusted hearing configuration and a learned audio adjustment parameter.

15. An apparatus comprising:

a memory storing a hearing impaired profile associated with a hearing aid device;

a speaker proximate to the hearing aid device; and a control unit to:

communicate with the memory, the speaker, and the hearing aid device;

determine a first audio signal is to be output by the apparatus;

in response to the determination:

muting the hearing aid device;

adjusting the first audio signal according to the hearing impaired profile; and sending the adjusted first audio signal to the speaker, such that the first audio signal is output only from the speaker; and determining a second audio signal is to be output by the hearing aid device, wherein the second audio signal comprises speech; and in response to the determination that the second audio signal is to be output:

unmuting the hearing aid device;

adjusting the second audio signal based on the hearing impaired profile; and sending the adjusted second audio signal to the hearing aid device.

16. The apparatus of claim 15, wherein the hearing impaired profile is based on at least one of a manual audio adjustment and a learned audio adjustment parameter.

17. The apparatus of claim 15, wherein the first audio signal is entertainment audio.

18. A method comprising:

coupling, by a control unit, a hearing aid device and a speaker proximate to the hearing aid device;

accessing a hearing impaired profile associated with the hearing aid device;

determining a first audio signal is to be output;

in response to the determination:

muting the hearing aid device;

adjusting the first audio signal according to a hearing impaired profile associated with the hearing aid device; and sending the first audio signal to the speaker, such that the first audio signal is output only from the speaker; and determining a second audio signal is to be output by the hearing aid device, wherein the second audio signal comprises speech; and;

in response to the determination that the second audio signal is to be output:

unmuting the hearing aid device;

adjusting the second audio signal based on the hearing impaired profile; and sending the adjusted second audio signal to the hearing aid device.

* * * * *